United States Patent [19]

Zaehringer

[11] 4,353,774

[45] Oct. 12, 1982

[54] APPARATUS FOR FORMING TUCKS IN A PIECE OF MATERIAL AND FOR SECURING THOSE TUCKS BY A HEAT-SEALED REINFORCEMENT

[75] Inventor: Andre Zaehringer, Strasbourg-Meinau, France

[73] Assignee: Vestra-Union, S.A., Paris, France

[21] Appl. No.: 231,153

[22] Filed: Feb. 3, 1981

[30] Foreign Application Priority Data

Feb. 6, 1980 [FR] France ..... 80 02892

[51] Int. Cl.[3] ..... B32B 31/20; D05B 35/08

[52] U.S. Cl. ..... 156/443; 112/132; 112/134; 112/144; 112/145; 112/146; 112/427; 156/474; 156/581; 156/583.1

[58] Field of Search ..... 156/443, 462, 470, 471, 156/474, 581, 583.1; 112/427, 132, 134, 144–146; 270/32, 41

[56] References Cited

U.S. PATENT DOCUMENTS

| | | | |
|---|---|---|---|
| 1,263,870 | 4/1918 | DeVoe | 112/145 |
| 2,658,551 | 11/1953 | Bender | 156/474 X |
| 4,079,682 | 3/1978 | Nishiwaki | 112/134 |
| 4,093,483 | 6/1978 | Jacobs | 156/474 X |

*Primary Examiner*—Caleb Weston

*Attorney, Agent, or Firm*—Young & Thompson

[57] ABSTRACT

An automatic unit for the programmable tucking in of part of a piece of material and the automatic fixing of this tuck by a heat-sealed reinforcement comprises two machines arranged at an angle of 150° relative to one another and symmetrical with respect to the median axis separating them. The components of the two machines are identical and each machine comprises a flat worktable, a main sliding support positioned behind the worktable, a lower row of fixed needles integral with the sliding support, an upper row of movable needles fixed to the sliding support, a mechanical device for the forward movement above the upper row of needles supporting an eccentric cylinder, a double-faced heating plate having a flat face and a face provided with equidistant slots and being mounted on a rotary shaft located over the worktable, a holding plate movable on this shaft for holding part of a piece of material, a mechanical gripping device, a member on the worktable between the holding plate and gripping device when the holding plate is lowered and the material is gripped between it and the gripping device, a series of jacks for controlling movement of various components and position detectors for monitoring the performance of the machine.

7 Claims, 9 Drawing Figures

APPARATUS FOR FORMING TUCKS IN A PIECE OF MATERIAL AND FOR SECURING THOSE TUCKS BY A HEAT-SEALED REINFORCEMENT

BACKGROUND OF THE INVENTION

This invention relates to a machine for making clothes and more specifically to an automatic unit for the programmable tucking in of part of a piece of material and the automatic fixing of this tuck by means of a heat-sealed reinforcement.

At present, numerous different procedures are possible for tucking in a piece of material, for example the arm-hole into a back piece. Thus, it is possible to iron the material with manual shaping of the part to be worked, fix a heat-sealed reinforcement by means of an iron after making a manual or mechanical tuck with blocking by a suction table, or stitching a braid on a flat sewing machine equipped with a differential displacement gear.

However, the aforementioned variants of the tucking in operation have numerous disadvantages. These include the need for a relatively expensive training of the operator when the work is carried out manually, a variable tucking value as a function of the clothes as well as the skill and knowledge of the operator when stitching a braid on a sewing machine equipped with a differential gear and a lack of similarity between the tucks on two sides when it is important to ensure correct symmetry between the left and right-hand parts of an article of clothing.

SUMMARY OF THE INVENTION

The object of the invention is to obviate these disadvantages.

Accordingly, the present invention provides an automatic unit for a programmable tucking in of part of a piece of material and the automatic fixing of this tuck by means of a heat-sealed reinforcement, said unit comprising two machines arranged at an angle of 150° relative to one another and symmetrical with respect to the median axis separating them, the components of the two machines being identical and each machine comprising a substantially flat worktable, a main sliding support positioned behind the worktable, a lower row of fixed needles integral with the sliding support, an upper row of movable needles fixed to the sliding support, a mechanical device for forward movement above the upper row of needles supporting an eccentric cylinder, a double-faced heating plate having a first substantially planar face and a second face provided with equidistant slots, a rotary shaft located over the worktable on which the heating plate is mounted, a holding plate movable about the rotary shaft for holding part of a piece of material, a mechanical gripping device which moves around a shaft fixed to the holding plate, a member positioned on the worktable between the holding plate and the gripping device parallel to the latter when the holding plate is in the lowered position and the gripping device is actuated and whose actual characteristics define the modification of the tucking-in line of the piece of material after gripping between the holding plate and the gripping device and which is interchangeable, a series of jacks permitting all the mechanical movements necessary to perform said tucking in and position detectors for ensuring satisfactory operation of the machine.

BRIEF DESCRIPTION OF THE DRAWINGS

The invention will now be further described, by way of example, with reference to the accompanying diagrammatic drawings, in which.

DESCRIPTION OF PREFERRED EMBODIMENT

Figure 1:
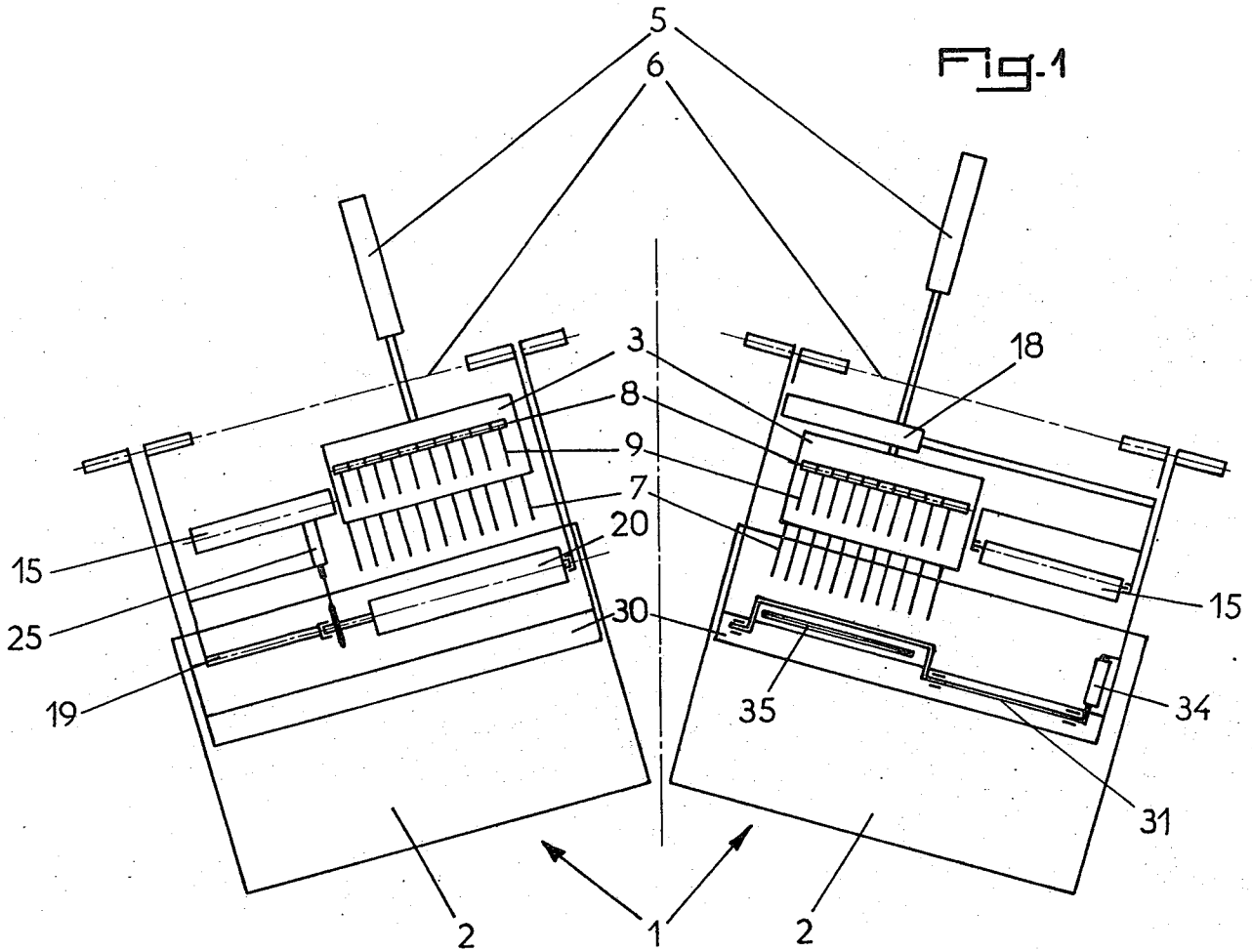
FIG. 1 is a plan view of one embodiment of an automatic unit according to the invention.

Reference will first be made to FIG. 1 of the drawings in which an automatic unit for a programmable tucking in of a part of a piece of material and the automatic fixing of said tuck by means of a heat-sealed reinforcement is essentially constituted by two machines 1 arranged at an angle of 150° from one another and symmetrical with respect to the median axis separating them, the components of the two machines being identical.

Figure 2:
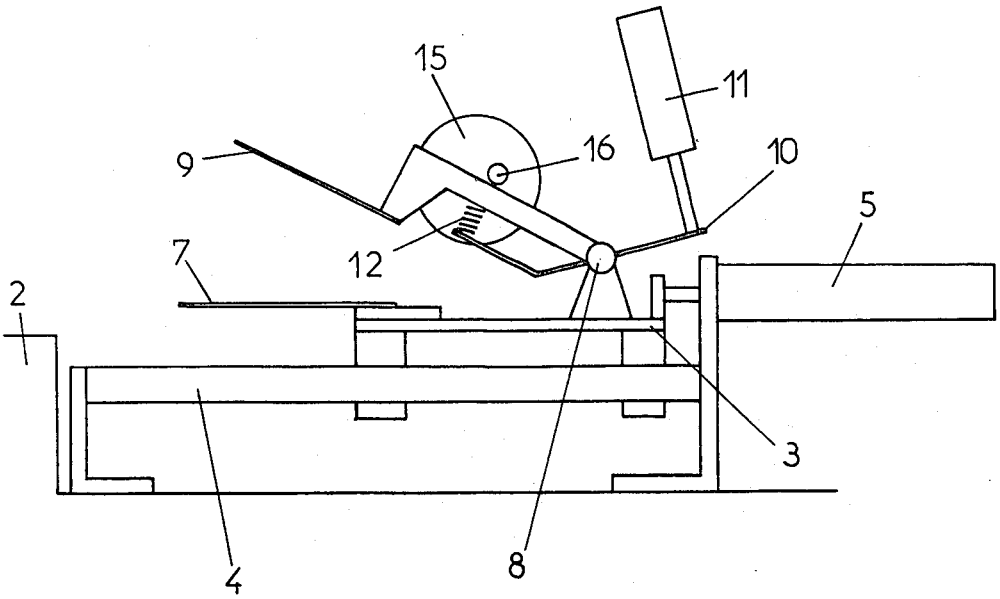
FIG. 2 is a side elevation of the sliding support and the upper and lower rows of needles forming part of a machine of the unit shown in FIG. 1.
Figure 4:
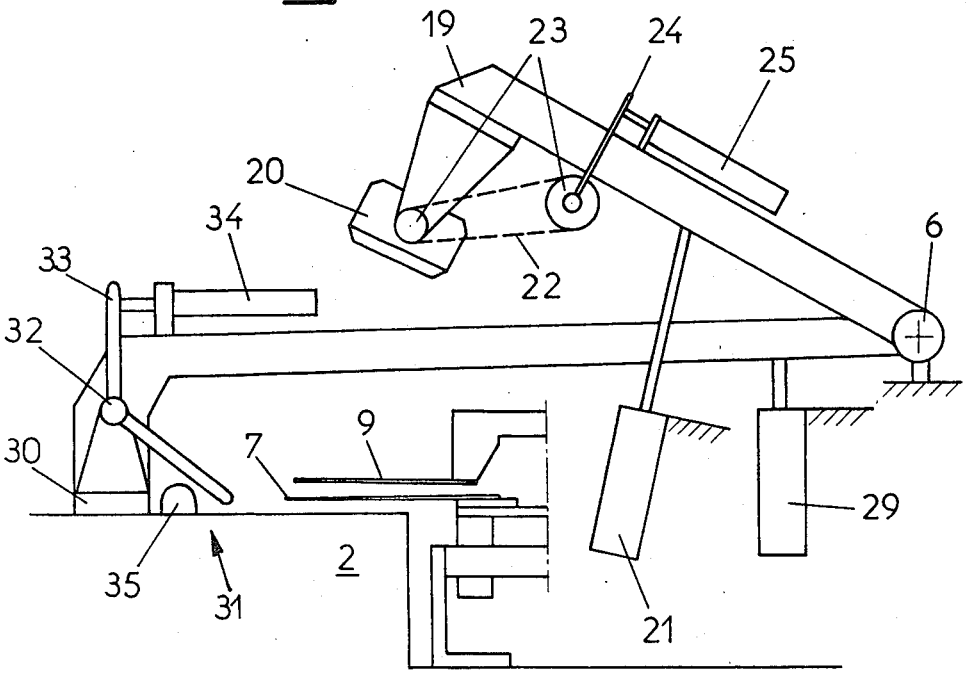
FIG. 4 is a side elevation of the double-faced heating plate and the holding plate with the gripping device forming part of a machine of the unit shown in FIG. 1.
Figure 3:
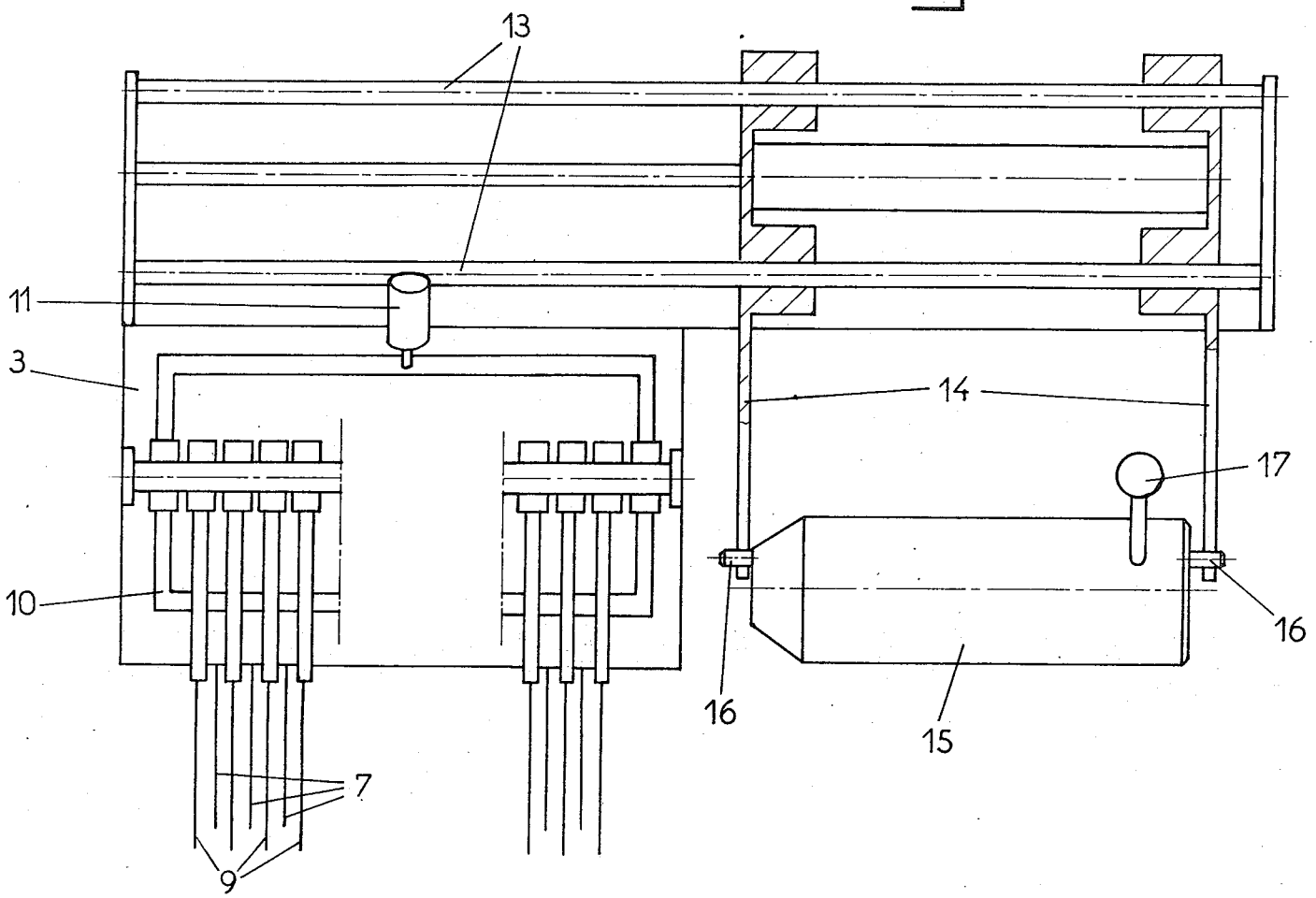
FIG. 3 is a plan view of the eccentric cylinder, its sliding support and the rows of needles forming part of a machine of the unit shown in FIG. 1.
Figure 5:
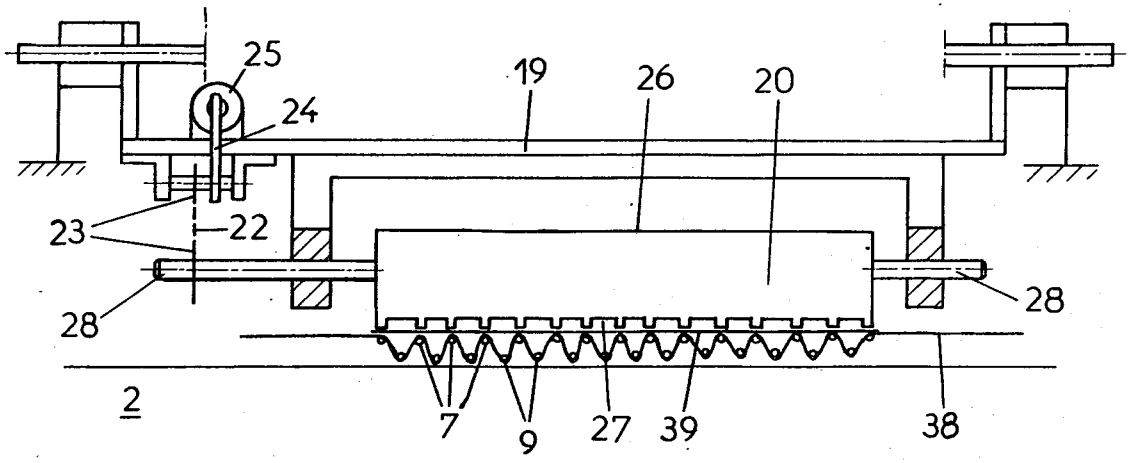
FIG. 5 is a front elevation of the double-faced heating plate and the two rows of needles during the fitting of a heat-sealed reinforcement.

Each machine 1 comprises a flat worktable 2 behind which is arranged a main sliding support 3 displaceable on two shafts 4 under the action of a jack 5 (FIG. 2) and a rotary shaft 6 permitting the pivoting of various plates (FIGS. 1 and 4). In its front portion turned towards the worktable 2, the support 3 carries a row of lower fixed needles 7 and, via a shaft 8, a row of upper movable needles 9 which are independent of one another and actuated by means of a frame 10 on which acts a jack 11, as well as springs 12 or similar elastic members connecting the frame 10 to the needles 9. As a result of these springs 12, each needle 9 has a freedom of movement relative to the frame 10. The needles 9 are spaced in such a way that each of them fits in a gap between two fixed needles 7. Moreover, the support 3 is displaceable under the action of the jack 5 from a position shown at the right of FIG. 1 and in FIG. 4, to a position shown at the left of FIG. 1 and in FIG. 2, in order to bring the needles 7 and 9 respectively over and outside the surface of the worktable 2.

Figure 8:
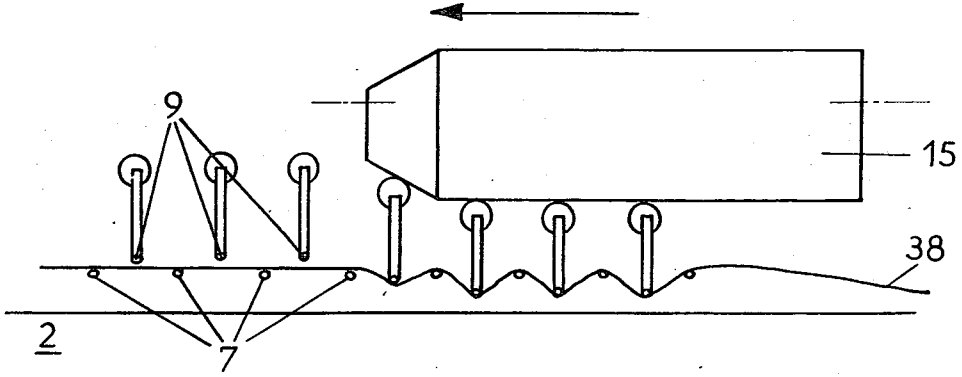
FIG. 8 shows the operation of the movable needles by means of the eccentric cylinder.

To the rear portion of the main sliding support 3 is fixed a mechanical device incorporating two parallel shafts 13 and on which is guided by means of two arms 14 an eccentric cylinder 15 mounted on the arms by means of an offset shaft 16 and movable on the latter by means of a handle 17. The cylinder 15 is displaceable above the support 3 and movable needles 9 by means of a jack 18. As a result of its forward movement above the movable needles 9, lowered via the jack 11 and the frame 10 over the piece of material and the fixed needles 7, the eccentric cylinder 15 moves the needles 9 between the needles 7 by a distance regulatable by the manual rotation of the cylinder 15 by means of the handle 17. This penetration of the needles 9 between the needles 7 serves to bring about the desired tucking-in value of the piece of material (FIG. 8).

The jack 11 lowers the needles 9 over the piece of material in such a way that the latter is flat between two rows of needles and the forward movement of the eccentric cylinder 15 under the action of the jack 18 brings about the successive penetration of the needles 9 between the needles 7 by the value given by the eccentricity of the cylinder 15.

A pivoting support 19 which carries a double-faced heating plate 20 at its end is mounted on the rotary shaft 6. The support 19 is pivoted by a jack 21 and the heating plate 20 is mounted in a pivotable manner on the end of the support 19. A chain 22 and pinion 23 assembly actuated by means of a lever 24 on which acts a jack 25 permits a 180° rotation of the plate 20 with a possibility of an approximately 2° clearance in the end positions (FIG. 4).

The heating plate 20 has a flat face 26 and a face 27 having equidistant slots, whose gaps correspond to those of the fixed needles 7 of the lower row and is articulated on the support 19 by its shaft 28 in thermally insulating bearings. The plate 20 can be rotated only in the raised position of the support 19 and the angular clearance of approximately 2° in the end positions serves to permit a flat contact between the planar surface 26 of the plate 20 and the worktable 2, as well as between the slotted surface 27 and the needles 7.

A plate 30 for holding the material on the worktable 2 is mounted on the rotary shaft 6 in a pivotable manner by means of a jack 29. The plate 30 is provided with a mechanical gripping device 31 constituted by a movable frame articulated in bearings 32 and whereof one blade 33 is actuated by a jack 34 raising and lowering the frame on the worktable 2. The gripping device 31 can be actuated only after the lowering of the plate 30 onto the worktable 2 and the securing of a piece of material. An interchangeable member 35 is also provided on the worktable 2 positioned between the plate 30 and the gripping device 31 parallel to the latter when the plate 30 is lowered and the device 31 actuated. The characteristics thereof define the modification of the tucking-in line of the piece of material with respect to its original line.

The automatic unit according to the invention is also provided with push buttons for actuating the various members and also position detectors (not shown) for ensuring a satisfactory operation of the equipment.

The operation of the automatic unit according to the invention is explained hereinafter in connection with the tucking in of the material of an arm-hole between points 36 and 37 of a jacket back piece 38.

Figure 6:
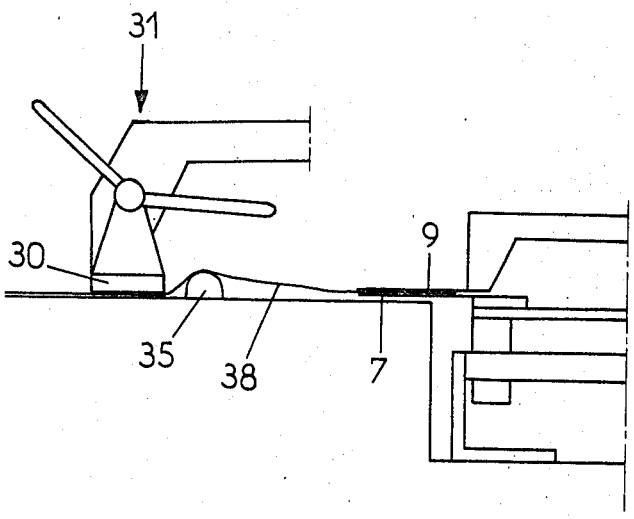
FIGS. 6 and 7 show the operation of the gripping device.
Figure 7:
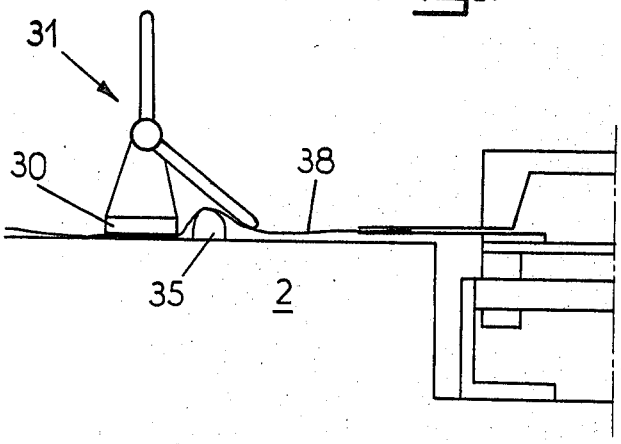
Figure 9:
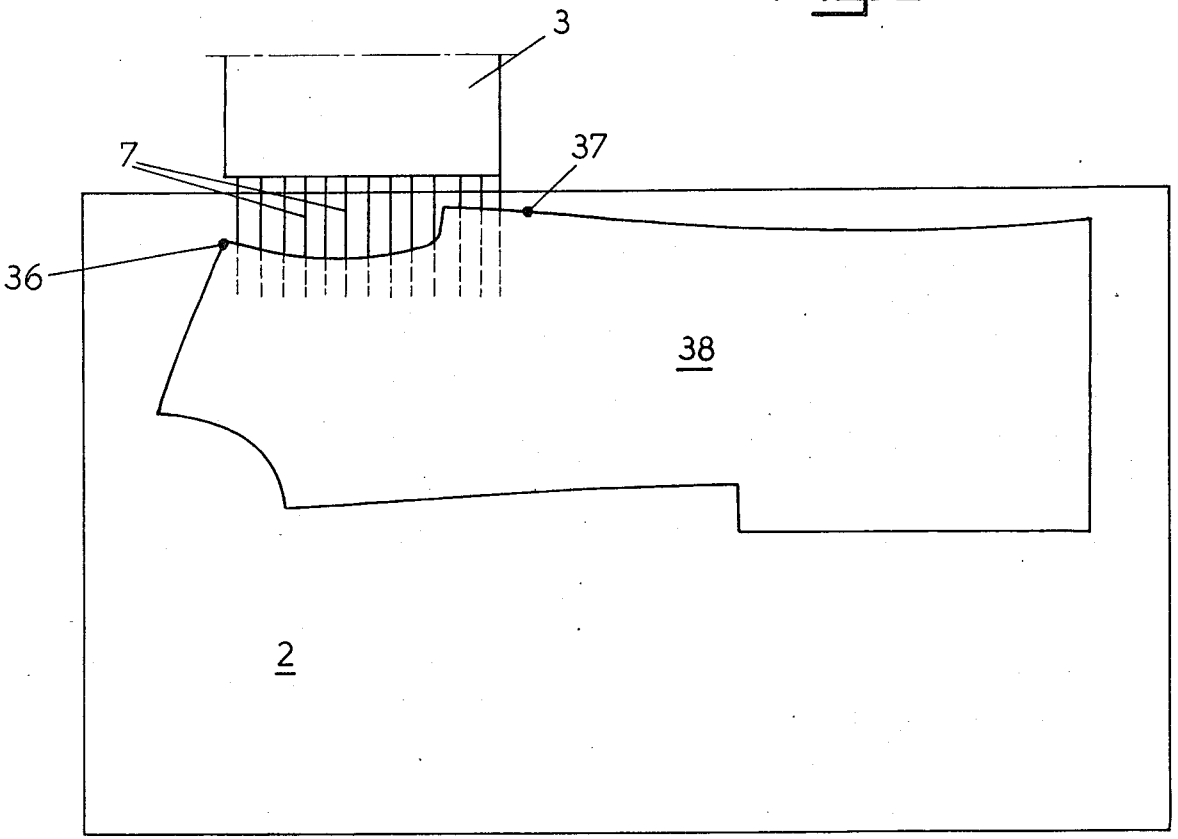
FIG. 9 is a plan view of a jacket back piece resting on the worktable.

The back piece 38 is placed on the worktable 2 above the member 35 in such a way that the edge of the material between points 36 and 37 is placed on the fixed needles 7 of the lower row (FIG. 9), all the other elements being raised above the level of the worktable 2. By operating a push button, an operator can lower the movable needles 9 by means of the jack 11 above the material, but out of contact therewith. An end-of-travel detector controls the forward movement of the eccentric cylinder 15 of the needles 9 (FIG. 8) by means of the jack 18. As a result of this movement, the needles 9 are successively lowered into the corresponding gap between the fixed needles 7 and cause a linear tucking in of the material between points 36 and 37. The extent of the tuck is a function of the eccentricity of the cylinder 15, initially regulated by means of the handle 17. An end-of-travel detector of the eccentric cylinder 15 actuates the jack 29 which lowers the holding plate 30 onto the worktable 2 for fixing the material 38 along its median line. An end-of-travel detector of the plate 30 actuates the gripping device 31 by means of the jack 34 acting on the blade 33. Thus, the material 38, gripped by the needles 7 and 9 and secured above the member 35 is tensioned between said two components above the worktable 2 and is moved towards the latter with a deformation of the line between the points 36,37 which is a function of the dimensional characteristics of the member 35. Thus, the lowering of the movable frame of the device 31 onto the worktable 2 has the effect of forming a loop of material above the member 35 and of causing a proportional displacement of the edge of the fabric towards the holding plate 30 (FIGS. 6 and 7).

After obtaining the deformation of the line between points 36,37, the operator places a heat-sealable reinforcement 39 above the needles 7 and 9 and along said line, the adhesive face being turned towards the material. The operator then presses a push button to start the heat-sealing operation consisting of fixing the reinforcement 39 to the material as a result of heat action. To this end, the heating plate 20 is lowered under its own weight with its slotted face on reinforcement 39 so as to bring about the fixing of the tuck by adhesion of the reinforcements at the joining points with the material held by the fixed needles 7. The duration of this adhesion is determined by means of a per se known regulatable timing device. At the end of the adhesion time, the timing device actuates the jack 21, which raises the plate 30 by means of the support 19 and an end-of-travel detector of the latter retracts the needles 7 and 9 from the surface of the worktable 2 by means of the jack 5 acting on the main sliding support 3. At the end of retraction, the latter actuates another detector which controls rotation of the heating plate 20 by means of the jack 25, lever 24, pinions 23 and chain 22 to bring its flat face 26 towards the worktable. Following this rotation, the plate 20 is again lowered towards the worktable 2 to press the reinforcement 39 on the material 38 in such a way that the material is heat-sealed to the non-extensible reinforcement. Following the final tuck fixing, the operator actuates the jack 34 by means of a push button. A push button is then pressed to actuate the jack 29 in order to release the pressure on the piece of material 38, so that it can be removed from the machine and a new tucking and fixing operation can commence.

As a result of the automatic unit according to the invention, it is possible to simultaneously carry out a tucking operation, followed by the fixing of the left and right-hand pieces of material with maximum precision and in a relatively short time, in such a way that efficiency is significantly increased.

The invention is not limited to the embodiment described and represented hereinbefore and various modifications can be made thereto without departing from the scope of the invention.

I claim:

1. Apparatus for forming tucks in a piece of material and for securing said tucks by means of a heat-sealed reinforcement, comprising a flat work table, a lower set of spaced needles, an upper set of spaced needles, means for sliding said sets of needles endwise above the work table, means for moving the upper set of needles vertically relative to the lower set of needles to form tucks in a piece of flexible material disposed on the work table between said sets of needles, means for releasably securing said material to the work table, a double-faced heating plate having a first substantially flat face and a second face having a plurality of slots therein that have the same spacing as the lower set of needles, and means for moving said heating plate toward and away from said needles and for turning said heating plate so that one or the other of said faces thereof confronts said lower set of needles, whereby when a piece of said material is disposed between said sets of needles and said needles are so positioned as to form tucks in the material and said heating plate is rotated so that said slots confront the material, and a heat-sealable reinforcement is disposed between said material and said heating plate and said heating plate is pressed against said heat-sealable reinforcement, said heat-sealable reinforcement will be bonded to said material in the regions of said first set of needles so as to bond said heat-sealable reinforcement to said material in spaced regions, and when said needles are withdrawn lengthwise from said tucks and said heating plate is rotated so that said substantially flat face confronts the material and said substantially flat face is moved toward and against said heat-sealable reinforcement to press said material against said work table, said material is bonded to said heat-sealable reinforcement between said spaced regions.

2. Apparatus as claimed in claim 1, there being two units of said apparatus identical to each other and arranged at an angle of 150° relative to each other in side-by-side relationship.

3. Apparatus as claimed in claim 1, both said sets of needles being disposed on a slidable support disposed behind said work table, said lower set of needles being fixed to said support and said upper set of needles being swingably mounted on said support.

4. Apparatus as claimed in claim 1, said means for moving said upper set of needles vertically comprising a horizontal cylinder mounted for rotation about a horizontal axis eccentric to the axis of the cylinder, said cylinder being engageable with said second set of needles thereby selectively to predetermine the depth to which said upper needles penetrate between said lower needles according to the rotated position of said cylinder.

5. Apparatus as claimed in claim 1, said means for rotating said heating plate comprising a chain and pinion assembly and a jack for rotating said chain and pinion assembly.

6. Apparatus as claimed in claim 1, and jacks for actuating said releasably securing means, for moving and rotating said heating plate, and for advancing and retracting said needles.

7. Apparatus as claimed in claim 1, in which said lower needles are parallel to each other and horizontal and said upper needles are parallel to each other.

* * * * *